US007078632B2

(12) United States Patent
Komatsu

(10) Patent No.: US 7,078,632 B2
(45) Date of Patent: Jul. 18, 2006

(54) FOUR-DIRECTIONAL SWITCHING DEVICE

(75) Inventor: Shinji Komatsu, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/013,809

(22) Filed: Dec. 16, 2004

(65) Prior Publication Data

US 2005/0139458 A1 Jun. 30, 2005

(30) Foreign Application Priority Data

Dec. 24, 2003 (JP) ..... 2003-427252

(51) Int. Cl.
*H01H 9/26* (2006.01)

(52) U.S. Cl. ..... 200/5 R; 200/5 A

(58) Field of Classification Search ..... 200/5 A, 200/5 R, 5 E, 418, 6 R, 17 R, 310–314, 517
See application file for complete search history.

(56) References Cited

U.S. PATENT DOCUMENTS

| | | | | |
|---|---|---|---|---|
| 5,468,924 | A * | 11/1995 | Naitou et al. | 200/6 A |
| 5,536,911 | A * | 7/1996 | Madill | 200/6 A |
| 5,689,095 | A * | 11/1997 | Kawase | 200/5 R |
| 5,691,517 | A | 11/1997 | Yamamoto et al. | |
| 6,246,019 | B1 * | 6/2001 | Nakamura et al. | 200/6 A |
| 6,348,664 | B1 * | 2/2002 | Kozuma | 200/6 A |
| 6,445,377 | B1 | 9/2002 | Shimomura | |
| 6,525,280 | B1 * | 2/2003 | Chan et al. | 200/6 A |
| 6,580,039 | B1 * | 6/2003 | Nakade et al. | 200/6 A |
| 6,586,689 | B1 * | 7/2003 | Kuriyama | 200/6 A |
| 6,586,690 | B1 * | 7/2003 | Shimomura et al. | 200/6 A |
| 6,613,989 | B1 * | 9/2003 | Tsuda et al. | 200/4 |
| 6,787,716 | B1 * | 9/2004 | Menche | 200/6 A |
| 6,852,938 | B1 * | 2/2005 | Nakade | 200/200 |
| 6,876,313 | B1 * | 4/2005 | Hsiung et al. | 341/35 |

FOREIGN PATENT DOCUMENTS

| | | |
|---|---|---|
| JP | 10-106397 | 4/1998 |
| JP | 2003-217403 | 7/2003 |

* cited by examiner

*Primary Examiner*—Michael Friedhofer
*Assistant Examiner*—Lisa Klaus
(74) *Attorney, Agent, or Firm*—Brinks Hofer Gilson & Lione

(57) ABSTRACT

A four-directional switching device includes a driving member 2, a pair of hollow protruding portions 6*b*, and other pair of hollow protruding portions 6*b*. The driving member 2 covers an operating member 3 supports the operating member 3 using a second axial portion 2*c* using a predetermined straight line in a planar direction of the operating member 3 as a center of rotation, and is supported by a first axial portion 2*b* with respect to a case 1 using a straight line in a direction orthogonal to the predetermined straight line as a center of rotation. The pair of hollow protruding portions 6*b* are opposed to the driving member 2 and operated by manipulating the rotational direction of the driving member 2 following the operation of the operating member 2 to press sliders 7 using slider pressing portions 2*e* of the driving member 2. The other pair of hollow protruding portions 6*b* are opposed to the operating member 3 and operated by manipulating the rotational direction of the operating member 3 following the operation of the operating member 3 to press the sliders 7 using slider pressing portions 3*d* of the operating member 3.

3 Claims, 7 Drawing Sheets

FOUR-DIRECTIONAL SWITCHING DEVICE

This application claims the benefit of priority to Japanese Patent Application No. 2003-427252 filed on Dec. 24, 2003, herein incorporated by reference.

BACKGROUND OF THE INVENTION

1. Field of the Invention

The present invention relates to a four-directional switching device which performs switching in response to pressing operations in four directions of an operating member.

2. Description of the Related Art

Conventionally, a mirror switch is typically employed as such a four-directional switching device in the related arts, in which a driver can remote-control from his seat left and right mirrors mounted on a body of a vehicle, as disclosed in Japanese Patent Application Publication No. 10-106397 further described below.

FIG. 6 is a cross-sectional view of a four-directional switching device of the related art taken along one direction (6—6 direction of FIG. 8 to be described later), FIG. 7 is a cross-sectional view of the four-directional-switching device taken along other direction (7—7 direction of FIG. 8 to be described later), and FIG. 8 is an exploded perspective view of the four-directional switching device.

This four-directional switching device is mainly comprised of a casing forming an outer shell of the switching device, an operating member 23 exposed from an opening 22 formed in the casing 21, a support member 24 supporting the operating member 23 tilted in various directions, a print substrate 25 fixed on the casing 21, a rubber sheet 26 mounted on the print substrate 25, and four sliders 27 interposed between the rubber sheet 26 and the operating member 23.

The operating member 23 is comprised of a cover 28 formed of a synthetic resin protruded from the opening 22 and a rotating member 29 formed of a synthetic resin mounted on the other side of the cover 28, and the cover 28 and the rotating member 29 are formed into one body as described later. Four display portions 28*a* representing tilt directions are formed on a surface of the cover 28, and four restriction piece 30 are formed into one body which are protruded downward from a center portion of the other side of the cover 28 as shown in FIG. 6, and these restriction pieces 30 are disposed at an equal interval of about 90°. In addition, four suspension pieces 31 are formed into one body, which are protruded downward from an outer side of the restriction pieces 30. In the meantime, four stoppers 32 are formed into one body which are protruded upward on the surface of the rotating member 29 as shown in FIG. 6, and these stoppers 32 are connected to each other as a ring type, and four interconnections 33 extend from between stoppers 32 toward a center of the rotating member 29, and a spherical member 34 is formed in an interconnecting position of each interconnection 33. As a result, a portion surrounded by the spherical member 34, each of the interconnections 33 and each of the stoppers 32 becomes a transparent hole 35. In addition, four elastic pieces 36 are formed into one body which are protruded upward from an outer side of respective stoppers 32, and these elastic pieces 36 are snapped in the suspension pieces 31, respectively so that the cover 28 and the rotating member 29 are formed into one body. In this case, each restriction piece 30 is inserted to the corresponding transparent hole 35, and a predetermined spacing is ensured between the spherical portion 34 and each of the restriction pieces 30.

The support member 24 is formed of a synthetic resin and is fixed on the casing 21 using a proper means such as a snapping-in means. As shown in FIG. 8, four support pieces 38 are formed into one body in a center portion of the support member 24 while being sectioned into four by a cross-shaped slit 37, and a guide portion 40 is formed at a leading end of an extension wall 39 which extends outward from a bottom portion of each slit 37. Each support piece 38 is curved, the spherical portion 34 is put into the operating member 23 from a top end of each support piece 38 described above, and each interconnection 33 is inserted into the corresponding slit 37, and an inner side of each restriction piece 30 is in contact with an outer surface of the support piece 38 while an outer side of each restriction piece 30 is in contact with each stopper piece 32. In addition, the slider 27 is inserted to each guide portion 40 to be guided upward and downward directions. The slider 27 is formed of a transparent light-guiding material such as an acrylic resin, and its top end is in contact with a bottom surface of the rotating member 29 while its bottom end is in contact with a hollow protruding portion 44 of the rubber sheet 26 to be described later.

A lamp 41 as a light source is mounted and a plurality of fixed contacts 42 are formed at an equal interval of about 90° centered on the lamp 41 on the print substrate 25. In the meantime, a hole 43 for allowing the lamp 41 to penetrate is formed in the rubber sheet 26 while four hollow protruding portions 44 are formed to be bulged at an equal interval of about 90° centered on opening 43, and four sets of switching elements has each movable contact 45 formed on an inner bottom portion of each hollow protruding portion 44 and each fixed contact 42 on the print substrate 25. The rubber sheet 26 is mounted on the print substrate 25, and both of the rubber sheet and the print substrate are positioned by pin, hole, and so forth which are not shown.

For assembling it comes to assemble the multi-directional switching device constructed as above, the slider 27 is first inserted into each guide portion 40 of the support member 24, and the support member 24 is fixed to an inner surface of the casing 21. The spherical portion 34 is fixed inside from a top end of each support piece 38 while each interconnection 33 of the rotating member 29 is forced to be in place with respect to the corresponding slit 37 of the support member 24. At this time, since the cover 28 is not formed into one body with the rotating member 29, each support piece 38 elastically deforms the transparent hole 35 outward and returns to its original state while the spherical portion 34 is fixed within each support piece 38, so that the spherical portion 34 may be snapped in each support piece 38. Each restriction piece 30 of the cover 28 is then forced to be in place with respect to the corresponding transparent hole 35, and each suspension piece 31 is snapped in the elastic piece 36 after the cover 28 is pressed against the rotating member 29, so that the cover 28 and the rotating member 29 are formed into one body. As a result, each restriction piece 30 is in contact with an outer surface of each support piece 38 so that the extension of the support piece 38 is prevented, and the spherical portion 34 is surely supported by each support piece 38. Furthermore, since the stopper piece 32 is disposed at an outer side of each restriction piece 30, the outward deformation of the restriction piece 30 is hindered by the stopper piece 32, so that the extension of the support piece 38 may be surely prevented.

Next, an operation of the multi-directional input switch device assembled as described above will be described. When a peripheral portion of the cover 28, for example, a right side of the cover 28 of FIG. 7 is depressed from its non-operating state shown in FIGS. 6 and 7, the spherical portion 34 is supported by the support piece 38 of the support member 24, so that the cover 28 and the rotating member 29 (i.e. operating member 23) are tilted in a clockwise direction of FIG. 7 centered on the spherical portion 34. In addition, the slider 27 positioned right of FIG. 7 is depressed by the rotating member 29 to thereby press the hollow protruding portion 44 of the rubber sheet 26 which is positioned right below the slider 27, so that the hollow protruding portion 44 is buckled to be deformed to generate a click sense while the movable contact 45 comes in contact with the opposing fixed contact 42 to thereby being in a switching on state. However, when hand is taken off from the cover 28 in such a tilted state, by means of the elastic force of the hollow protruding portion 44 of the rubber sheet 26, a portion of the rotating member 29 moving downward by the slider 27 is pushed upward so that the operating member 23 returns to its original state as shown in FIGS. 6 and 7. As a result, the movable contact 44 which was in a contact state is spaced from the fixed contact 42 to thereby being in a switching off state again. In addition, when the lamp 41 is turned on at night or in dark places, the light from the lamp 41 is guided toward the rear surface of the cover 28 through each slider 27 so that each display portion 28*a* is illuminated.

However, in the related art, the operating member 23 is comprised of the cover 28 and the rotating member 29, in which the spherical portion 34 of the rotating member 29 (operating member 23) is snapped in each support piece 38 of the casing 21 and each support piece 38 is prevented from being extended by the restriction piece 30.

Accordingly, only the snap interconnection between the spherical portion 34 and each support piece 38 may prevent the spherical portion 34 from being dislocated from each support piece 38, so that the spherical portion 34 may be dislocated from each support piece 38 when a high impact is forced to the operating member 23 or the like, which may lead to a dislocation of the operating member 23, thereby making it difficult to enhance the mechanical intensity.

In addition, the slider 27 acts as a light guiding member of guiding lights to the operating member 23, however, four sliders 27 are required, and it is difficult to ensure that lights are guided. Furthermore, there exists a support piece 38 and a supporting portion from the casing 21 of the support member 38, whereby making it difficult to illuminate them with only one light guiding member disposed at their center.

SUMMARY OF THE INVENTION

It is an object of the present invention to provide a four-directional switching device which allows an operating member to be readily and surely pressed and supported in four directions to provide pressure switches for four directions, and allows a space when seen from a plane view to be effectively utilized and an illuminating structure to be simplified.

In order to achieve the above-mentioned object, the present invention provides a four-directional switching device, which includes an operating member; a driving member attached to and rotatably supporting the operating member, using a predetermined straight line as a center of rotation; a case rotatably supporting the driving member using a straight line in a direction orthogonal to the predetermined straight line as a center of rotation; a pair of switches disposed to be opposed to the operating member and pressed by the operating member when the operating member is rotated by an operation of the operating member using the predetermined straight line as the center of rotation; and other pair of switches disposed to be opposed to the driving member and pressed by the driving member when the driving member is rotated by an operation of the operating member using the straight line in the direction orthogonal to the predetermined straight line as a center of rotation.

By means of the structure described above, the operating member may be supported so as to be pressed in four directions to provide pressure switches for four directions. In addition, a space when seen from a plane view may be effectively utilized using a positional relationship for rotatably supporting the operating member and the driving member and a positional relationship of switch pressure portions of the operating member and the driving member.

In addition, in the above-mentioned four-directional switching device, a pair of bearing portions is disposed at one side of the driving member and a pair of bearing portions is disposed at the other side of the driving member to allow the operating member to be rotatably supported with respect to the driving member disposed between the pair of bearing portions disposed at the one side thereof, and the other pair of switches is disposed below a portion between the pair of bearing portions disposed at the one side of the driving member, and a distance between the pair of bearing portions disposed at the other side of the driving member is formed to be shorter than a distance between the pair of bearing portions disposed at the one side of the driving member, the driving member is rotatably supported in the case by the pair of bearing portions disposed at the other side thereof, and the pair of switches is disposed at an outer side between the pair of bearing portions disposed at the other side of the driving member to be pressed by the operating member.

By means of the above-mentioned structure, the present product when seen from a plane view may be downsized.

In addition, in the above-mentioned four-directional switching device, the driving member is formed as a light-guiding member, and an illuminating portion is formed at a bottom surface of the driving member.

By means of the above-mentioned structure, the illuminating structure may be readily formed and a center of the operating member may also be illuminated.

In addition, a wing portion is formed to be protruded outward from the driving member close to an inner surface of the operating member.

The present invention may provide pressure switches for four directions by allowing the operating member to be readily pressed and supported. In addition, a space of the present case when seen from a plane view may be effectively utilized using a positional relationship for rotatably supporting the operating member and the driving member and a positional relationship of switch pressure portions of the operating member and the driving member. In addition, the illuminating structure may be readily simplified as compared to the related art.

DESCRIPTION OF THE PREFERRED EMBODIMENTS

Hereinafter, one embodiment of the four-directional switching device of the present invention, which are applied to the same mirror switch of the vehicle as described in the related art, will be described with reference to the accompanying drawings.

Figure 1:
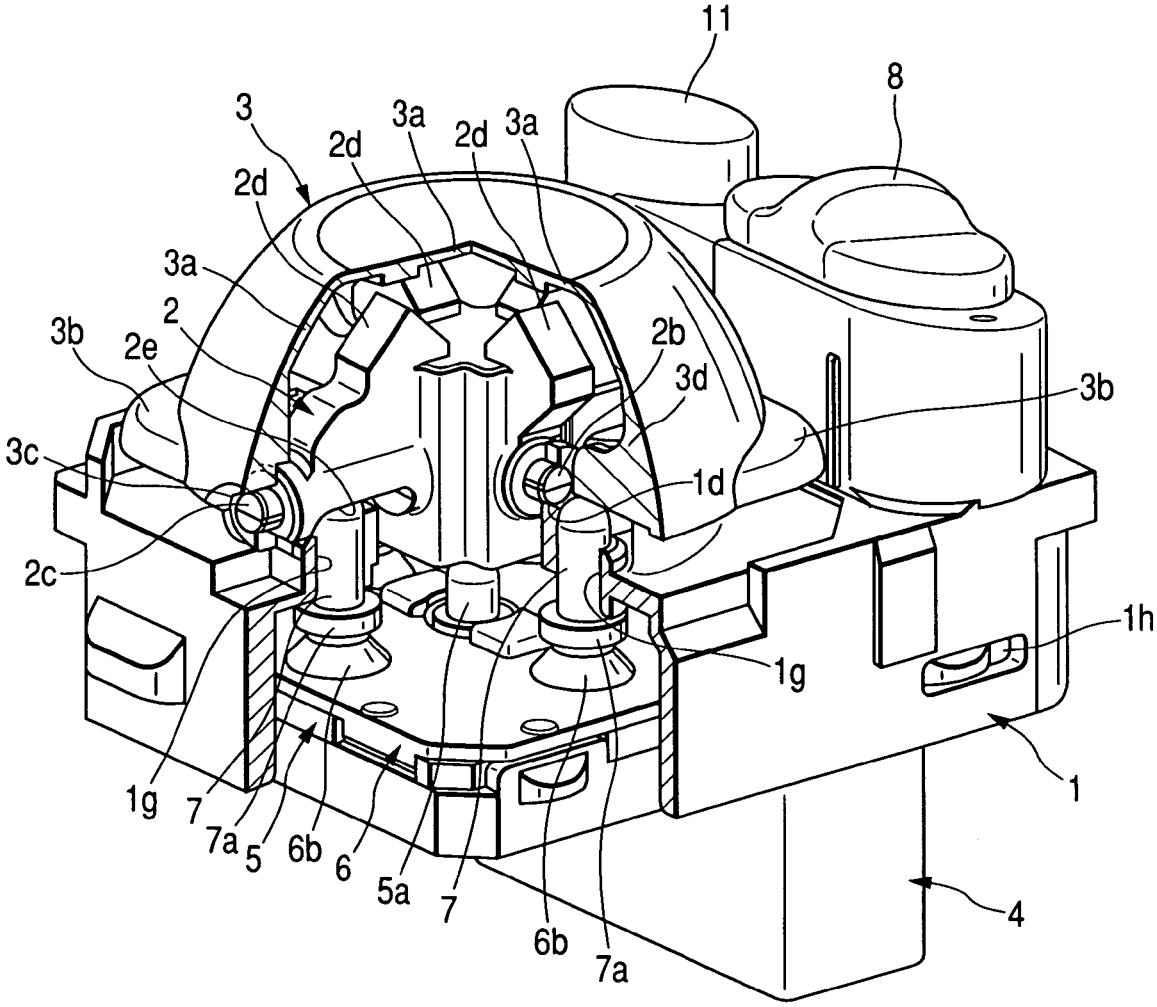
FIG. 1 is a perspective view illustrating a portion taken from a four-directional switching device in accordance with the present invention.
Figure 2:
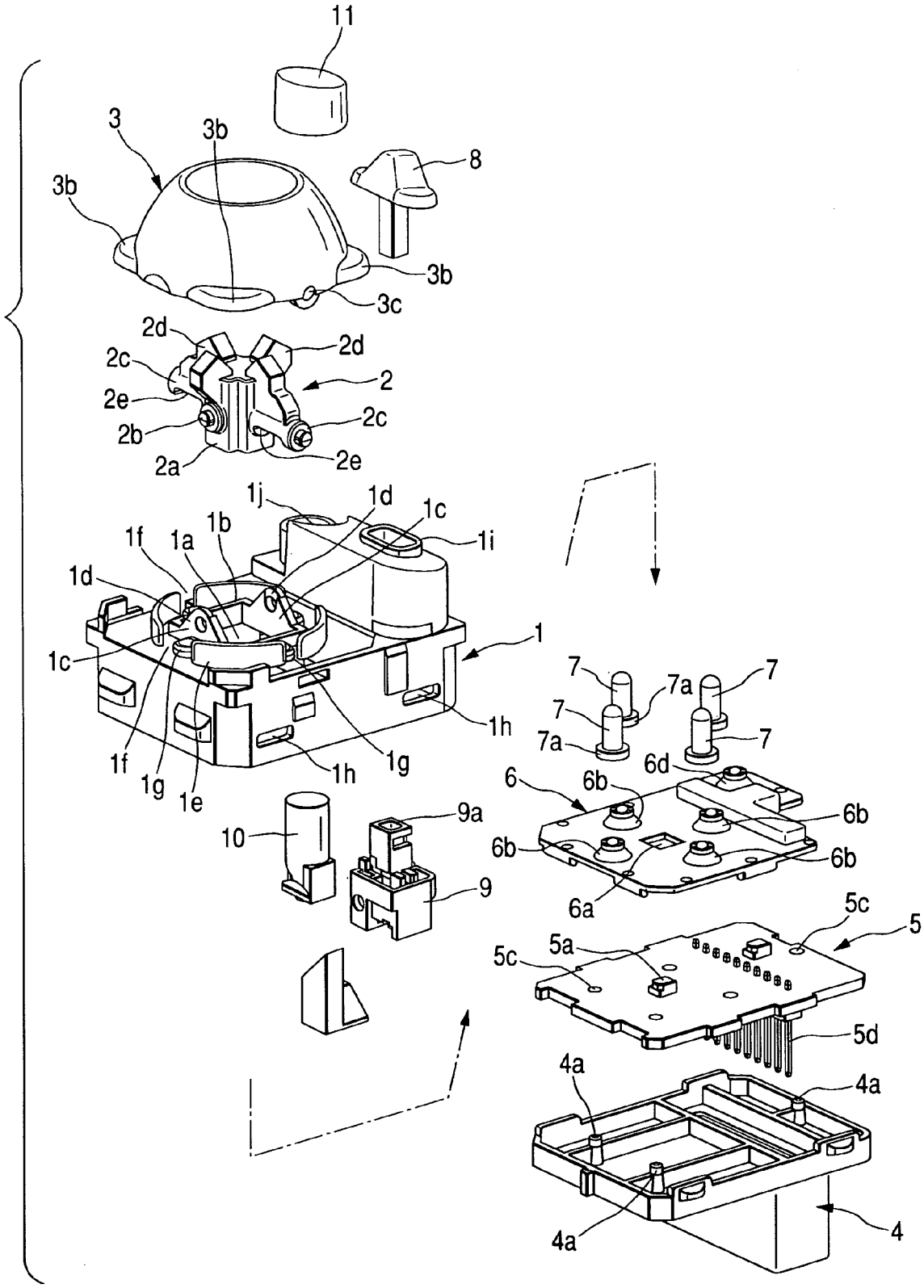
FIG. 2 is an exploded perspective view illustrating the four-directional switching device of FIG. 1.
Figure 3:
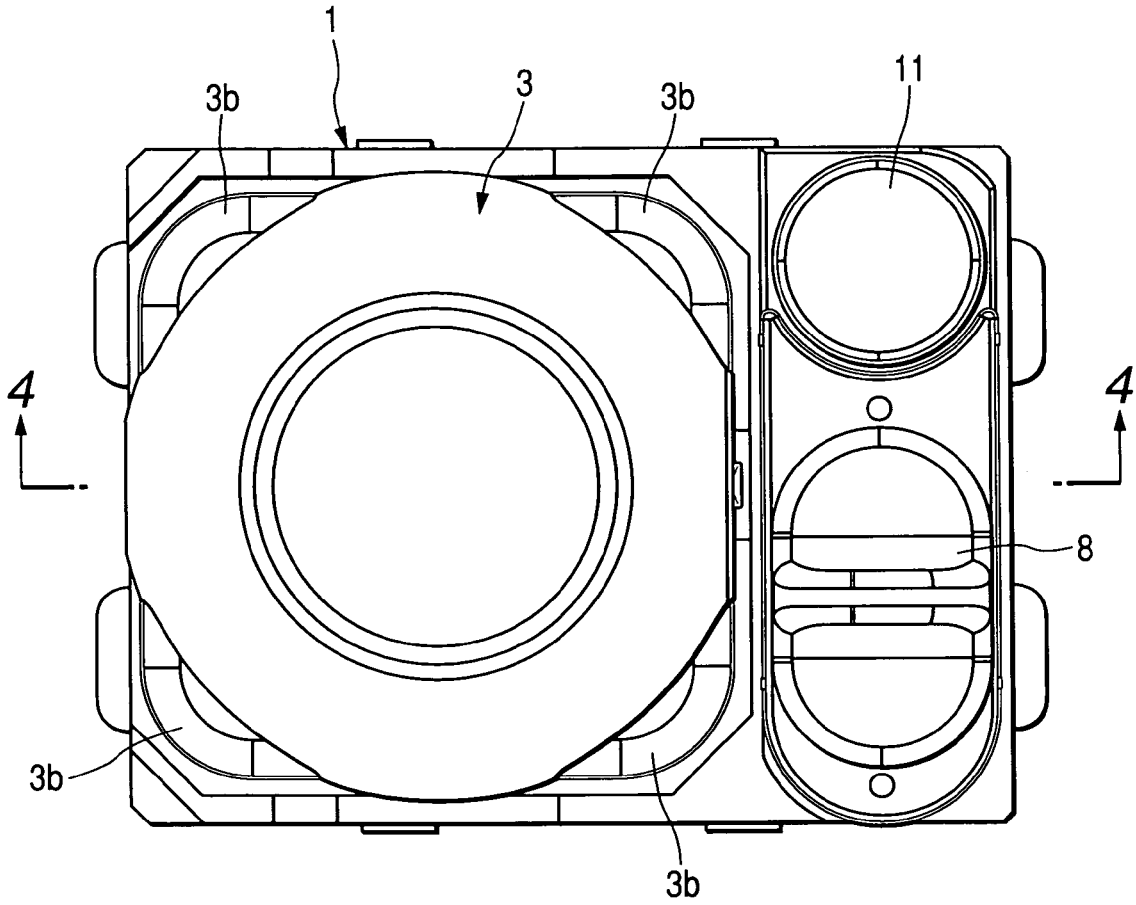
FIG. 3 is a plan view illustrating the four-directional switching device of FIG. 1.
Figure 4:
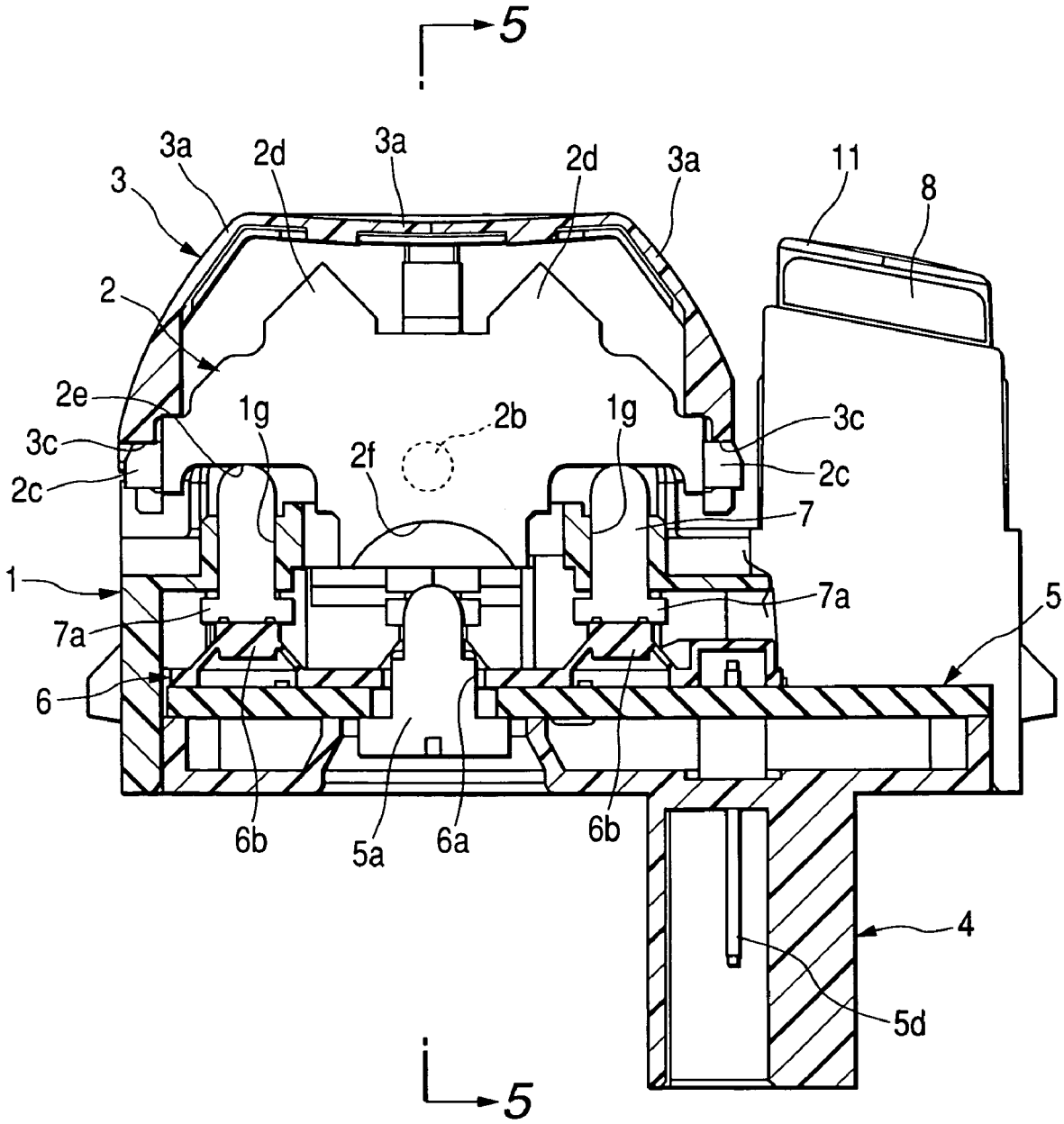
FIG. 4 is a cross-sectional view taken along the 4—4 line of FIG. 3.
Figure 5:
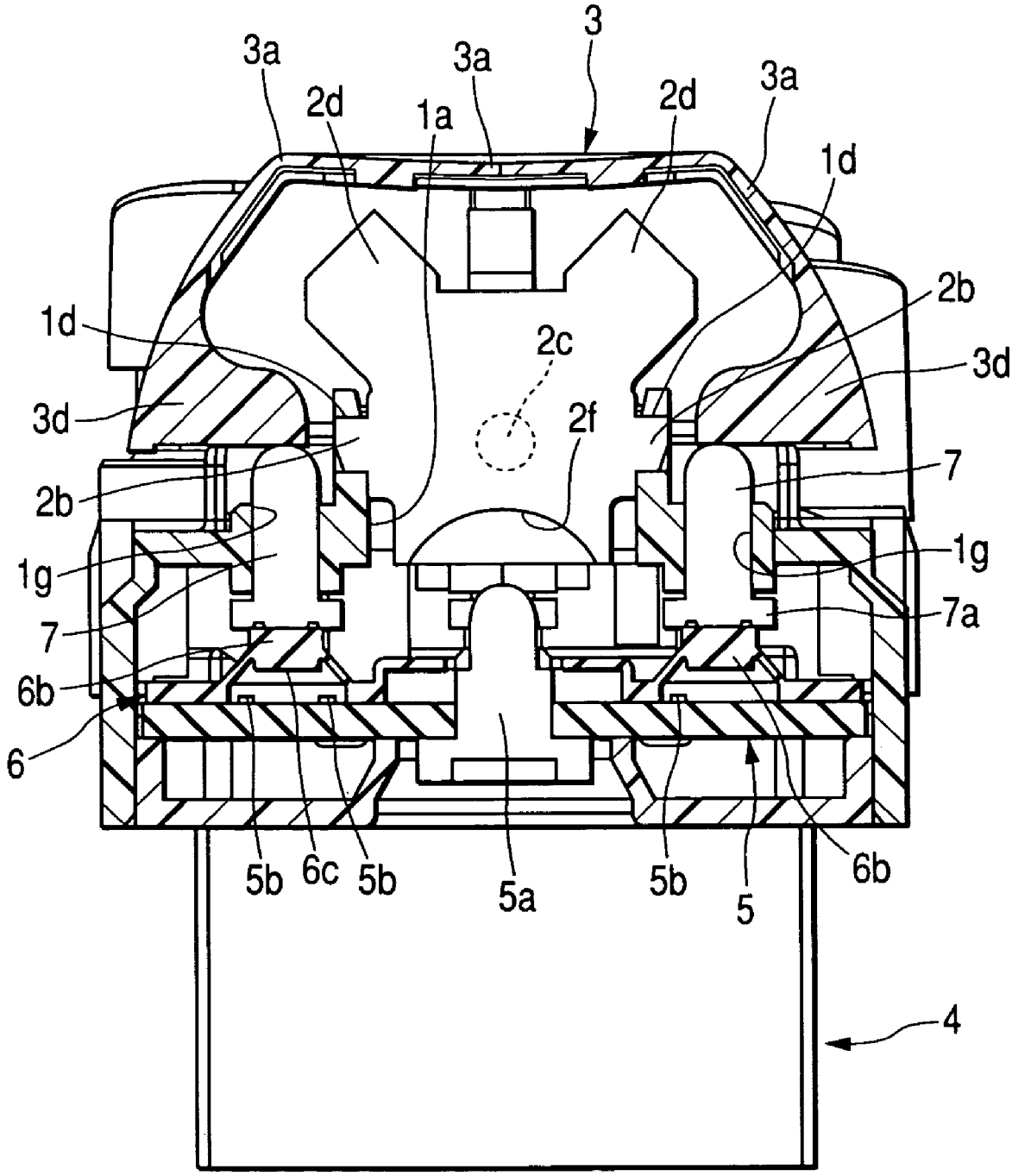
FIG. 5 is a cross-sectional view taken along the 5—5 line of FIG. 4.
Figure 6:
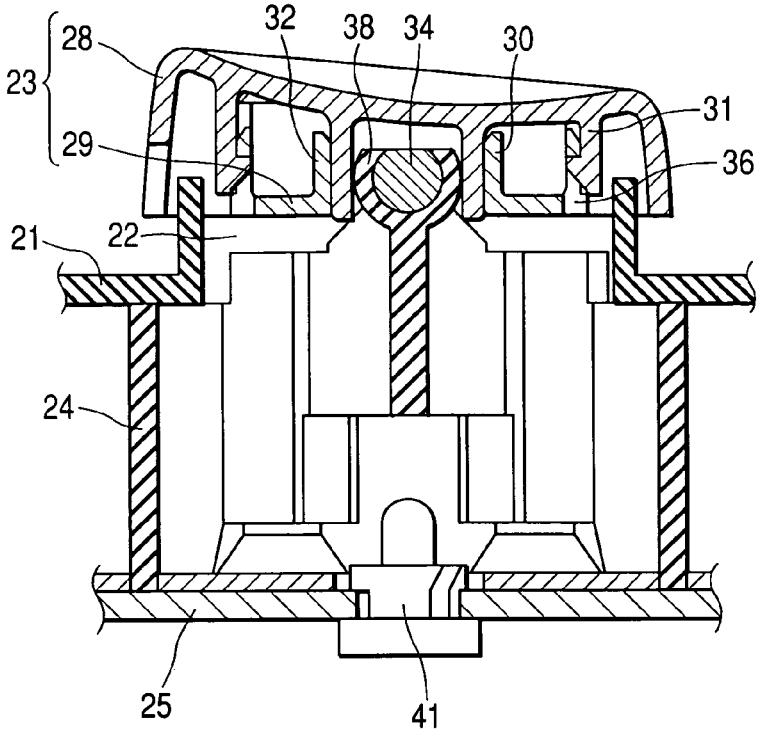
FIG. 6 PRIOR ART
FIG. 6 is a cross-sectional view of a four-directional switching device in accordance with the related art taken along one direction.
Figure 7:
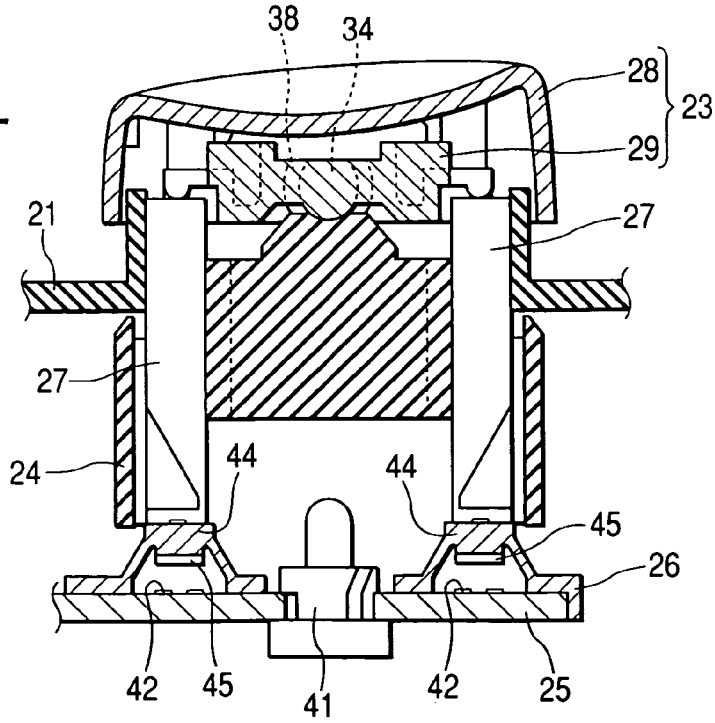
FIG. 7 PRIOR ART
FIG. 7 is a cross-sectional view of the four-directional switching device in accordance with the related art taken along other direction.
Figure 8:
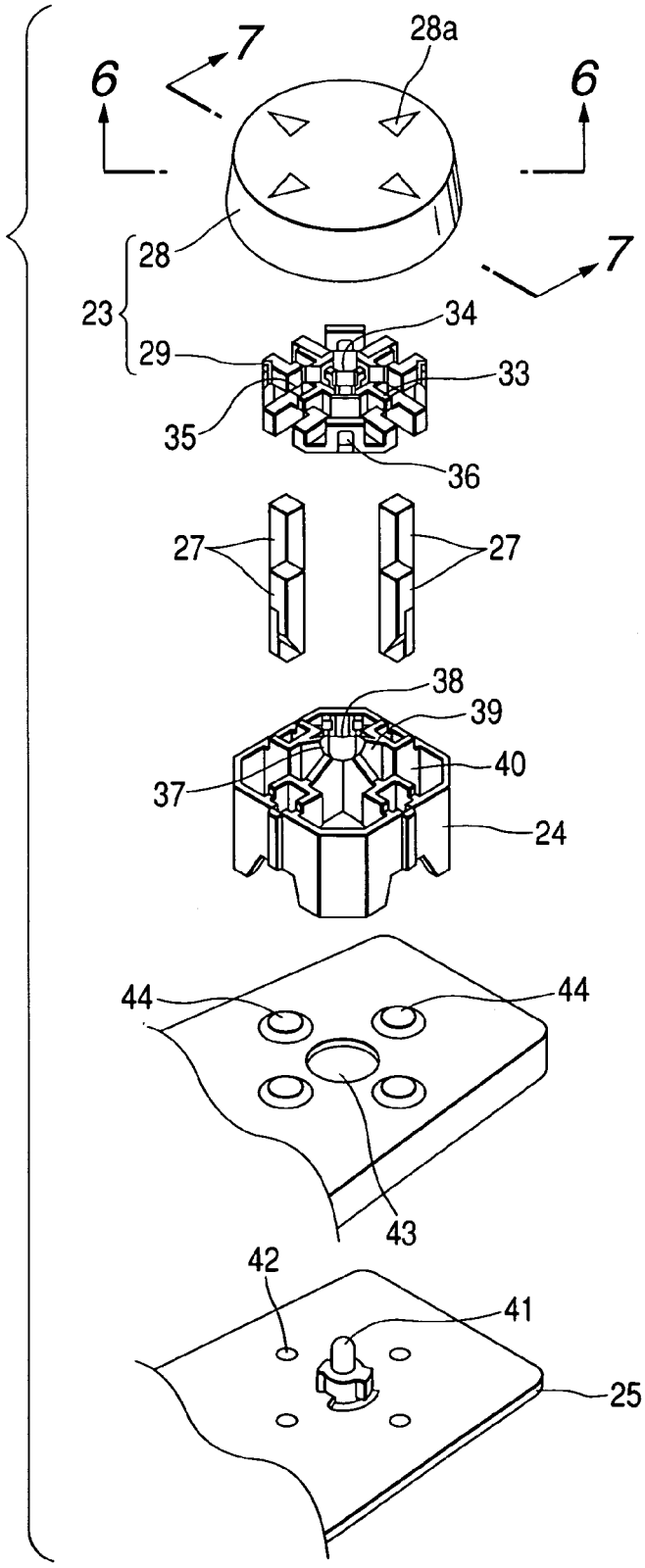
FIG. 8 PRIOR ART
FIG. 8 is an exploded perspective view of the four-directional switching device in accordance with the related art.

FIG. 1 is a perspective view illustrating a portion taken from a four-directional switching device in accordance with the present invention, FIG. 2 is an exploded perspective view illustrating the four-directional switching device of FIG. 1, FIG. 3 is a plan view illustrating the four-directional switching device of FIG. 1, FIG. 4 is a cross-sectional view taken along the 4—4 line of FIG. 3, and FIG. 5 is a cross-sectional view taken along the 5—5 line of FIG. 4.

The four-directional switching device of the present embodiment is mainly comprised of a case 1 forming an outer shell of the switching device with its bottom side being opened, a driving member 2 protruded from an opening 1*a* formed on a top side of the case 1 and rotatably supported in the case 1, an operating member 3 disposed to cover on the driving member 2 and rotatably supported in the driving member 2, a cover 4 covering a bottom surface of the case 1, a print substrate 5 fixed on the cover 4 and having a plurality of fixed contact pattern or the like printed, a rubber sheet 6 mounted on the print substrate 5, and four sliders 7 interposed between the rubber sheet 6, and the driving member 2 and the operating member 3. In addition, the case 1 has an operation knob 8 for switching right and left mirrors for controlling the switching selection of driving the right and left mirrors, a slide switch 9 in which the mirror switching operation knob 8 is mounted, a slider 10 for open-driving the mirror, and a pressure button 11 mounted on a top side of the slider 10 for open-driving the mirror.

In the case 1, substantially a rectangular-shaped opening 1*a* on its top surface, a wall 1*b* protruded along the edge of four sides of the opening 1*a*, triangle-shaped support pieces 1*c* protruded on the walls 1*b* of one set of the opposing edges, a set of bearing holes 1*d* protruded on upper portions of the support pieces 1*c*, a cylindrical portion 1*e* protruded so as to surround the wall 1*b*, notches 1*f* separating the cylindrical portion 1*e* into four sections on a line connecting the bearing holes 1*d* and 1*d* and on a line orthogonal to the connected line, guide holes 1*g* formed in an inner side of the cylindrical portion 1*e* to correspond to the notches 1*f* and to guide up and down movements of the sliders 7, relatively, and engagement holes 1*h* formed on its side wall surface to which engagement portions of the cover 4 are engaged.

In addition, in the case 1, a long hole 1*i* into which the mirror switching operation knob 8 is put to allow the mirror switching operation knob 8 to be slidable, and a cylindrical pressure button receiving portion 1*j* into which the slider 10 for open-driving the mirror and the pressure button 11 are put to allow the slider and the button to be operated.

The driving member 2 is formed as a light-guiding member, and includes a rectangular column type main body portion 2*a*, a first axial portion 2*b* protruded from an opposing side of the main body portion 2*a* and axially supported between the bearing holes 1*d* and 1*d* of the case 1, a second axial portion 2*c* protruded from the other opposing side of the main body portion 2*a*, disposed to be orthogonal to the first axial portion 2*b* to allow the operating member 3 to be axially supported, wing portions 2*d* protruded on top sides of the first axial portion 2*b* and the second axial portion 2*c* to be close to the inner surface of the operating member 3 and having a plane opposing to the display portion 3*a* of the operating member 3 to guide lights for illumination, slider pressure portions 2*e* having concave ends being formed at bottom portions of the second axial portion 2*c* and formed on the axis (a straight line) of the second axial portion 2*c* or right below the second axial portion, and a concave spherical shaped light-receiving portion 2*f* formed on a bottom surface of the main body portion 2*a*. The first axial portion 2*b* is formed to be shorter than the second axial portion 2*c*, and the wing portion 2*d* on the first axial portion 2*b* is not formed near the first axial portion 2*b*, so that the area may be used as a space for disposing the slider pressure portion of the operating member 3 to be described later. Accordingly, the driving member 2 may rotate centered on the first axial portion 2*b* which is axially supported by the bearing holes 1*d* of the case 1.

The second axial portion 2*c* of the driving member 2 rotatably supports the operating member 3 using a predetermined straight line of a planar direction of the operating member 3 as a center of rotation, while the first axial portion 2*b* rotatably supports the driving member 2 in the case 1 using a straight line in a direction orthogonal to the predetermined straight line as the center of rotation. In addition, smooth chamfering is performed on the first axial portion 2*b* and the second axial portion 2*c* when these portions are mounted to the bearing holes 1*d* and 3*c*, and is also performed on the bearing holes 1*d* and 3*c* where the chamfered portions slide, and both bearing holes 1*d* and 3*c* are expanded to be engaged with the chamfered portions by their elastic force.

The operating member 3 is dome-shaped with its top portion being planar, and when seen from its top plane and its surrounding plane, it includes four display portions 3*a*, four collar portions 3*b* protruded at edges of a bottom portion of the operating member, a pair of bearing holes 3*c* axially supporting the second axial portion 2*c* of the driving member 2 by inserting the second axial portion 2*c* to a pair of holes wherein a ring-shaped portion is formed downwardly from a bottom portion positioned on the diameter of the operating member 3 to thereby form the pair of holes, and a pair of slider pressing portions 3*d* protruded toward an inside from the diameter orthogonal to the pair of bearing holes 3*c*. Accordingly, since the bearing holes 3*c* are inserted to the second axial portion 2*c* of the rotatably driving member 2 as described above, the operating member 3 is axially supported by the second axial portion 2*c* orthogonal to the axis direction of the center of rotation of the driving member 2, so that the operating member 3 may be pressed in four directions. In addition, the intensity of the operating member 3 may be enhanced by the four collar portions 3*b*.

In addition, the pair of the slider pressing portions 3*d* of the operating member 3 is disposed in a space where the wing portions 2*d* are not formed in the first axial portion 2*b* shorter than the second axial portion 2*c* and near the first axial portion 2*b*, and the rotational operation of the operating member 3 allows the slider pressing portions 3*d* to press the corresponding sliders 7 downward as described above.

Each slider 7 is inserted to each guide hole 1*g* of the case 1, and these sliders 7 are guided in up and down directions by the guide holes 1*g*. Each of the sliders 7 is cylindrical column shaped, and its top end is spherical-shaped to be in contact with each slider pressing portion 2*e* of the driving member 2 or each slider pressing portion 3*d* of the operating member 3, and a dislocation preventing flange 7*a* is formed in its bottom end to be in contact with the hollow protruding portion 6*b* of the rubber sheet 6 to be described later.

The cover 4 serves to close the bottom opening end of the case 1, and the case 1 and the cover 4 are snapped to each other to form an outer shell of the mirror switching device. A fixing portion 4*a* for screwing the print substrate 5 is formed in the cover 4.

A lamp 5*a* as a light source, and a plurality of fixed contacts 5*b* at an equal interval of about 90° centered on the lamp 5*a* are formed in the print substrate 5. In addition, holes 5*c* for inserting screws, and a plurality of terminals 5*d* connected to a circuit pattern including the fixed contacts 5*b* and connected to an external device are formed in the print substrate 5.

In the meantime, in the rubber sheet 6, an opening 6*a* where the lamp 5*a* passes through is formed, and four hollow protruding portions 6*b* are bulged at an equal interval of about 90° centered on the opening 6*a*, and each set of four switching elements is comprised of the movable contact 6*c* formed in an inner bottom portion of the each hollow protruding portion 6*b* and the fixed contact 5*b* on the print substrate 5. The rubber sheet 6 is mounted on the print substrate 5, and both of them are positioned by pin, hole or the like which are not shown. Reference numerical 6*d* indicates a hollow protruding portion pressed by the slider 10 for open-driving the mirror. In addition, the hollow protruding portion 6*b* upward energizes the bottom surface of the slider 7 so that a top portion of the slider 7 is pressed to be contacted with the slider pressing portion 2*e* of the driving member 2 or the slider pressing portion 3*d* of the operating member 3, and the operating member 3 is supported in a neutral position. When the driving member 2 and the operating member 3 rotate, the dislocation preventing flange 7*a* may prevents the slider 7 from being dislocated even when the top portion of the slider 7 is dislocated from the slider pressing portion 2*e* or the slider pressing portion 3*d*.

Next, an operation of the present embodiment will be described.

In the non-operation state as shown in FIGS. 4 and 5, an elastic force of each hollow protruding portion 6*b* is applied to the corresponding slider pressing portion 2*e* of the driving member 2 and the corresponding slider pressing portion 3*d* of the operating member 3 through each slider 7, and the driving member 2 and the operating member 3 are supported in a neutral position (that is, a horizontal state in which a top surface of the operating member 3 is). When the peripheral portion of the operating member 3, for example, an area near the right display portion 3*a* of FIG. 4 is pressed from the neutral position, the operating member 3 together with the driving member 2 connected to the operating member tilts by means of the second axial portion 2*c* in a clockwise direction of FIG. 4 which is centered on the first axial portion 2*b* axially supported by the bearing holes 1*d* of the case 1. As a result, the slider 7 positioned in the right direction of FIG. 4 is pressed down by the slider pressing portion 2*e* of the driving member 2 to thereby press the hollow protruding portion 6*b* of the rubber sheet 6 which is positioned right below the slider pressing portion, so that the hollow protruding portion 6*b* is buckled to be deformed to generate a click sense while the movable contact 6*c* becomes in contact with the fixed contact 5*b* opposing the movable contact 6*b* to have a switching-on state. When a hand is taken off from the tilted operating member 3 as described above, by means of the elastic force of the hollow protruding portion 6*b* of the rubber sheet 6, the slider pressing portion 2*e* of the driving member 2 that has been moved downward is pushed up by aid of the slider 7, so that the driving member 2 and the operating member 3 return to their original states as shown in FIGS. 4 and 5. As a result, the movable contact 6*b* which was in a contact state is spaced from the fixed contact 5*b* to thereby have a switching-off state again. In addition, when the operating member 3 is manipulated, the operating member 3 only tilts in a clockwise direction in FIG. 4, and does not rotate centered on the second axial portion 2*c* with respect to the driving member 2 (See FIG. 5), so that the pair of slider pressing portions 3*d* of the operating member 3 slides on the spherical-shaped top end of the slider 7, however, the pair of the sliders 7 is not pressed downward to have these switching elements remained in their switching-off state.

In the meantime, when the display portion 3*a* and an area adjacent to the display portion 3*a* are pressed, the right or left display portion 3*a* of FIG. 5 is pressed in this case. For example, when the right display portion 3*a* is pressed, the operating member 3 tilts in a clockwise rotation direction in FIG. 5 centered on the second axial portion 2*c* of the driving member 2. At this time, the driving member 2 connected to the operating member 3 by means of the second axial portion 2*c* has its both first axial portions 2*b* supported by the bearing holes 1*d* of the case 1, so that the driving member 2 does not tilt with the operating member 3 but maintains in its current state. Together with the tilt operation of the operating member 3, the slider 7 positioned in the right side of FIG. 5 is pressed downward by the slider pressing portion 3*d* of the operating member 3 to thereby press the hollow protruding portion 6*b* of the rubber sheet 6 positioned right below the slider pressing portion, so that the hollow protruding portion 6*b* is buckled to be deformed to generate a click sense while the movable contact 6*c* becomes in contact with the fixed contact 5*b* opposing the movable contact to have a switching-on state. When a hand is taken off from the tilted operating member 3 as described above, by means of the elastic force of the hollow protruding portion 6*b* of the rubber sheet 7, the slider pressing portion 3*d* of the operating member 3 which has been moved downward is pushed up through the slider 7, 50 that the operating member 3 returns to its original state as shown in FIG. 5. As a result, the movable contact 6*b* which was in a contact state is spaced from the fixed contact 5*b* to thereby have a switching-off state again. In addition, when the operating member 3 tilts in a clockwise rotation direction in FIG. 5 as described above, the driving member 2 does not rotate centered on the second axial portion 2*c* (See FIG. 4), so that the pair of slider pressing portions 2*e* of the driving member 2 slides on the spherical-shaped top end of the slider 6, however, the pair of the sliders 7 is not pressed downward to have these switching elements remained in their switching-off state.

In addition, when the lamp 5*a* is turned on at night or in dark places, the light of the lamp 5*a* below the bottom surface of the main body portion 2*a* of the driving member 2 enters to the light-receiving surface 3*f* of the driving member 2 and is guided to the wing portion 2*d* through the main body portion 2*a*, which exit from the planar-shaped exit surface of the wing portion 2*d* to the rear surface of each display portion 3*a* of the operating member 3, so that the central display portion 3*a* and its peripheral display portions 3*a* of the operating member 3 are illuminated.

In addition, in the present embodiment, the first axial portion 2*b* and the second axial portion 2*c* are formed in the driving member 2, and the bearing holes 1*d* and 3*c* supporting the axial portions are formed in the operating member 3 in the case 1, however, the present invention is not limited thereto, but the axial portions and the bearing holes which constitute the bearing portion may be disposed in a member opposite to the above-mentioned member, which also has the same operation effect as the above-mentioned embodiment has.

In addition, in the present embodiment, the slider pressing portions 2*e* of the driving member 2 are disposed on the axis center of the second axial portion 2*c* (straight line) or right below the axial portion, however, the present invention is not limited thereto, the slider pressing portion may be disposed out of the axis center position (i.e. at a position orthogonal to the axis center or its lower position). In addition, positions of the switches may be changed according to the above-mentioned changes. In other words, in the embodiment, four switches are disposed at an equal interval of 90° around an intersection using as a center the intersection between the predetermined straight line and the straight line orthogonal to the predetermined straight line, each of one pair of switches and the other pair of switches may be disposed in the straight line or in positions opposed between the straight line and a straight line orthogonal to the straight line.

In addition, in the embodiment, there exists four switches, a pair of switches is pressed to the operating member 3, and the other pair of switches is pressed to the driving member 2. In addition, the straight line acts to connect the center of rotation of the operating member 3, and the orthogonal straight line acts to connect the center of rotation of the driving member 2.

In addition, in the embodiment, the first axial portion 2*b* of the driving member 2 is formed to be shorter than the second axial portion 2*c* so that a space (an indispensable area) outside a leading end of the first axial portion 2*b* of the driving member 2 is formed, and slider pressing portions 3*d* of the operating member 3 are disposed in the space to press the sliders 7, however, the present invention is not limited thereto, and a penetrating hole may be formed in the driving member 2 to allow the sliders 7 without forming the space to be inserted and penetrated.

According to the embodiment as constructed above, the four-directional switching device includes the operating member 3; the driving member 2 attached to the operating member 3 and rotatably supporting the operating member using a predetermined straight line as a center of rotation; the case 1 rotatably supporting the driving member 2 using a straight line in a direction orthogonal to the predetermined straight line as a center of rotation; the pair of switches disposed to be opposed to the operating member 3 and pressed by the operating member 3 when the operating member 3 is rotated by an operation of the operating member 3 using the predetermined straight line as the center of rotation; and the other pair of switches disposed to be opposed to the driving member 2 and pressed by the driving member 2 when the driving member 3 is rotated by an operation of the operating member 3 using the straight line in the direction orthogonal to the predetermined straight line as a center of rotation, so that the operating member 3 may be readily supported so as to implement four directional pressing. When a pressure is applied near the collar portions 3*b* of the operating member 3, a pair of switches adjacent to 90° may be pressed, which is not the main method used in the present invention. In addition, a space when seen from a plane view may be effectively utilized by means of a positional relationship of the bearing portion (the first axial portion 2*b*, the second axial portion 2*c*, and the bearing holes 1*d* and 3*c*) for rotatably supporting the operating member 3 and the driving member 2, and a positional relationship of the switch pressure portions 2*e* and 3*d* of the operating member 3 and the driving member 2.

In addition, a pair of the bearing portions (the second axial portion 2*c* and the bearing hole 3*c*) of one side and a pair of bearing portions (the first axial portion 2*b* and the bearing hole 1*d*) of other side are disposed in the driving member 2 to allow the operating member 3 to be rotatably supported with respect to the driving member 2 between the pair of bearing portions disposed at the one side thereto, and the other pair of switches is disposed below a portion between the pair of bearing portions disposed at the one side of the driving member, and a distance between the pair of bearing portions disposed at the other side of the driving member is formed to be shorter than a distance between the pair of bearing portions disposed at the one side of the driving member, and the driving member 2 is rotatably supported in the case 1 by the pair of bearing portions (the first axial portion 2*b* and the bearing hole 1*d*) of the other side, and the pair of switches is disposed at an outer side between the pair of bearing portions (the first axial portion 2*b* and the bearing hole 1*d*) disposed at the other side of the driving member to press the operating member 3, so that the producte may be downsized when seen from a plane view. A portion where the driving member 2 rotatably supports the operating member 3 becomes troublesome, so that the switch (slider 7) in that direction is pressed by the driving member 2, which leads to a good space efficiency. When this configuration is applied to have all switches (sliders 7) pressed by the operating member 3, the size of the device becomes increased, which may be overcome by the present invention.

In addition, the driving member 3 is formed as a light-guiding member, and an illuminating portion (having the light-receiving portion 2*f* and the lamp 5*a*) is formed at a bottom surface of the driving member 2, so that the illuminating structure may be facilitated, and a center portion of the operating member 3 may also be illuminated.

What is claimed is:

1. A four-directional switching device, comprising:

an operating member;

a driving member rotatably supporting the operating member attached thereto, using a predetermined straight line as a center of rotation;

a case rotatably supporting the driving member using a straight line in a direction orthogonal to the predetermined straight line as a center of rotation;

a pair of switches disposed to be opposed to the operating member and pressed by the operating member when the operating member is rotated by an operation of the operating member using the predetermined straight line as the center of rotation; and another pair of switches disposed to be opposed to the driving member and pressed by the driving member when the driving member is rotated by an operation of the operating member using the straight line in the direction orthogonal to the predetermined straight line as the center of rotation, wherein a pair of bearing portions is disposed at one side of the driving member and another pair of bearing portions is disposed at another side of the driving member to allow the operating member to be rotatably supported with respect to the driving member disposed between the pair of bearing portions disposed at the one side thereof, the other pair of switches is disposed below a portion between the pair of bearing portions disposed at the one side of the driving member, and a distance between the pair of bearing portions disposed at the other side of the driving member is formed to be shorter than a distance between the pair of bearing portions disposed at the one side of the driving member, the driving member is rotatably supported in the case by the pair of bearing portions disposed at the other side thereof, and the pair of switches is disposed at an outer side between the pair of bearing portions disposed at the other side of the driving member to be pressed by the operating member.

2. The four-directional switching device according to claim 1, wherein the driving member is formed as a light-guiding member, and an illuminating portion is formed at a bottom surface of the driving member.

3. The four-directional switching device according to claim 1, wherein a wing portion is formed to be protruded outward from the driving member close to an inner surface of the operating member.

* * * * *